US006615921B2

(12) United States Patent
Whitelaw et al.

(10) Patent No.: US 6,615,921 B2
(45) Date of Patent: Sep. 9, 2003

(54) APPARATUS AND METHOD FOR REMOTE ADJUSTMENT OF DRILL STRING CENTERING TO PREVENT DAMAGE TO WELLHEAD

(75) Inventors: Richard P. Whitelaw, Aberdeen (GB); Norman Brammer, Aberdeen (GB); Charles E. Jennings, Houston, TX (US)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 10/141,329

(22) Filed: May 8, 2002

(65) Prior Publication Data

US 2002/0148616 A1 Oct. 17, 2002

Related U.S. Application Data

(63) Continuation of application No. 09/659,314, filed on Sep. 12, 2000, now Pat. No. 6,394,186.
(60) Provisional application No. 60/173,571, filed on Dec. 29, 1999.

(51) Int. Cl.[7] ..... E21B 33/03
(52) U.S. Cl. ..... 166/349; 166/368; 166/85.1; 166/360; 166/374; 166/387; 166/240.1

(58) Field of Search ..... 166/349, 368, 166/85.1, 350, 360, 373, 371–387, 180, 191, 240.1

(56) References Cited

U.S. PATENT DOCUMENTS 3,602,303 A * 8/1971 Blenkarn et al.
4,147,221 A * 4/1979 Ilfrey et al.
6,394,186 B1 * 5/2002 Whitelaw et al.

* cited by examiner

*Primary Examiner*—Roger Schoeppel
(74) *Attorney, Agent, or Firm*—Bracewell & Patterson, L.L.P.

(57) ABSTRACT

A drill bit guide is mounted in a wellhead in place of a wear bushing. The bit guide is capable of guiding strings and tools through the wellhead without damage to the wellhead or string while drilling. In one version of the bit guide, a pair of linear actuators radially extend and retract separate halves of the bit guide to conform to the size of the object located between them. In another version of the bit guide, a set of interlocking arms and wear bars are articulated to form a circular opening having a variable inner diameter. A drill string may be lowered through a fully open bit guide or landed on top of a fully closed bit guide. The bit guide also can be moved to more closely receive the drill string passing through it to prevent damage to the drill string and the wellhead.

17 Claims, 9 Drawing Sheets

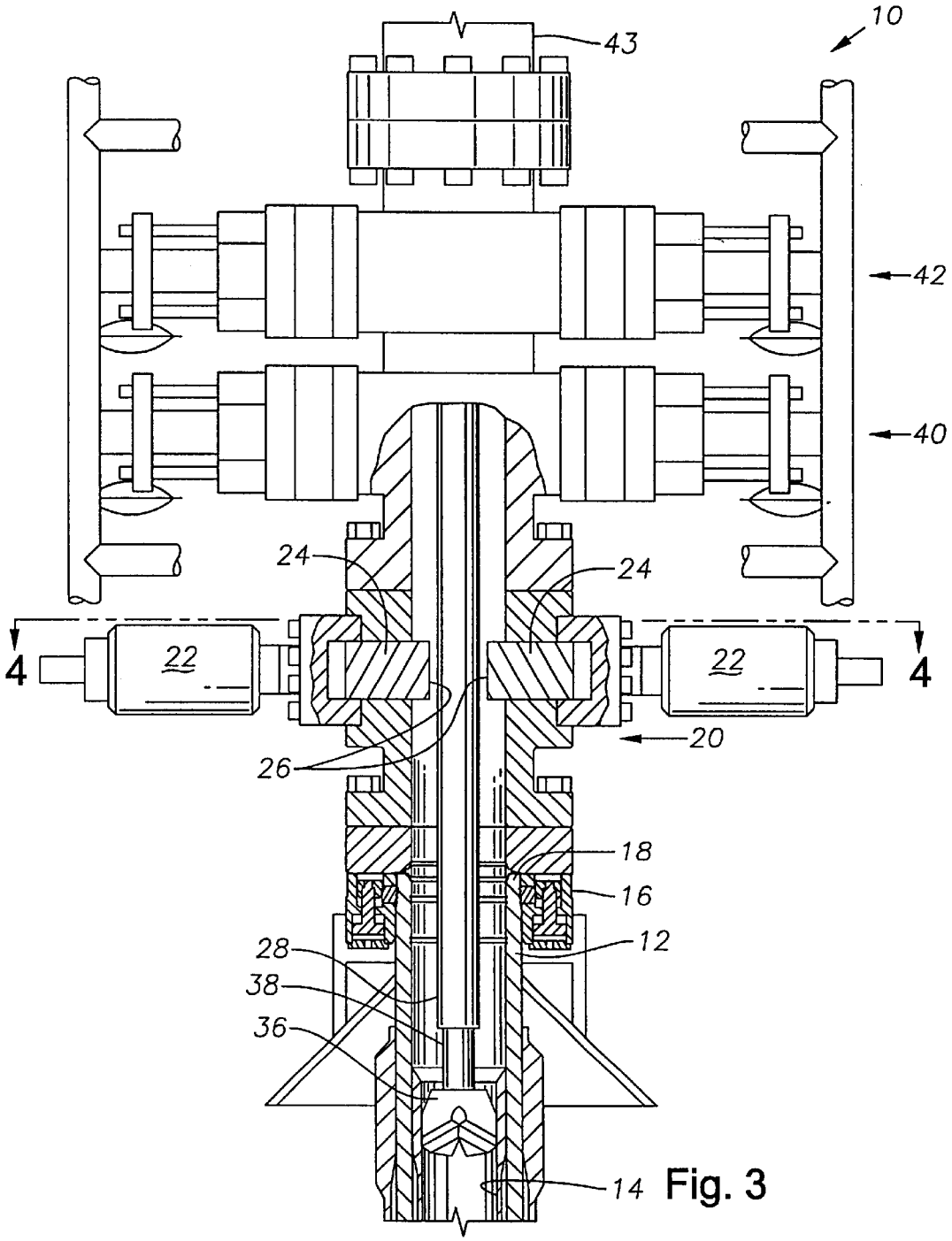
Fig. 3
Fig. 4
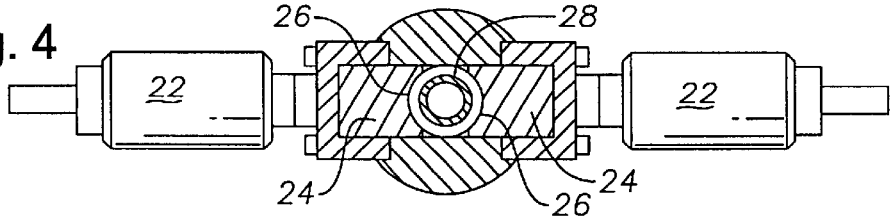

APPARATUS AND METHOD FOR REMOTE ADJUSTMENT OF DRILL STRING CENTERING TO PREVENT DAMAGE TO WELLHEAD

This application is a continuation of application Ser. No. 09/659,314, filed Sep. 12, 2000 now U.S. Pat. No. 6,394,186, which claimed priority from provisional application Ser. No. 60/173,571, filed Dec. 29, 1999.

This application is based on provisional application Serial No. 60/173,571 filed Dec. 29, 1999 entitled "Bit Guide Unit Above Wellhead Housing".

BACKGROUND OF THE INVENTION

1. Technical Field

The present invention relates in general to an improved system for reducing the wear of components in a well, and in particular to an improved system for remotely adjusting the centering of a drill string in a well to prevent damage to the wellhead.

2. Description of the Prior Art

In offshore wellhead equipment, there are instances in which an inner tubular member must be releasably locked into an outer tubular member within a well. For example, while drilling an offshore well with a jack-up drilling rig, a wellhead housing with a blowout preventer (BOP) is located on a string of casing that extends upward from the sea floor. The wellhead housing is located on a well deck below the rig floor. A riser extends upward from the wellhead housing to the rig floor. The drilling rig runs drill pipe down through the wellhead housing for drilling purposes. It is important to avoid damaging the bore of the wellhead housing and also the seal where it connects to the riser.

In the prior art, wear bushings are often deployed to prevent damage to the wellhead from the rotating drill pipe. Wear bushings are retained in the bore and installed remotely by lowering them through the riser. However, wear bushings are subject to a number of limitations and problems. For example, without some type of retention mechanism, a wear bushing can be dislodged by circulation of heavy solids or by tripping of the drill pipe through the wellhead during normal drilling operations. If the wear bushing is dislodged, it could become repositioned in the blowout preventer stack and cause damage to or failure of the blowout preventer to shut in the well during a pressure kick. Such a condition could subject the rig to a blowout, causing serious damage. Although there are various mechanisms for retaining wear bushings, such as shear pins, lock rings, and J-pins made of steel or other metallic alloys, users have experienced failure in activating or releasing these devices. It is difficult to recover the wear bushing if the locking mechanism fails to release.

Another problem with wear bushings is that they must be replaced occasionally during use, and then retrieved after drilling operations are complete. The time required to stop drilling, retrieve the wear bushing, and then replace it with a new one before recommencing operations is costly. Moreover, wear bushings are limited to a single size or internal diameter. Since the bore sizes of a single well may range from 7.5 inches to 18.75 inches, an unspent wear bushing must be replaced if the tooling required during operation is larger or smaller than the internal diameter of the wear bushing. Thus, an improved system for protecting wellhead assemblies is needed.

SUMMARY OF THE INVENTION

A drill bit guide is mounted above a wellhead in place of a wear bushing. The bit guide is capable of guiding strings and tools through the wellhead without damage to the wellhead or string while drilling. In one version of the bit guide, a pair of linear actuators radially extend and retract separate halves of the bit guide to conform to the size of the object located between them. In another version of the bit guide, a set of interlocking arms and wear bars are articulated to form a circular opening having a variable inner diameter. A drill string may be lowered through a fully open bit guide or landed on top of a fully closed bit guide. The bit guide also can be moved to more closely receive the drill string passing through it to prevent damage to the drill string and the wellhead.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

FIG. 3 is a partially-sectioned side view of the well of FIG. 1, wherein the drill bit has passed through the bit guide and the bit guide is guiding the drill string.

FIG. 4 is a partially-sectioned top view of the bit guide of FIG. 1 taken along line 4—4 of FIG. 3 showing the bit guides engaging the drill string.

DETAILED DESCRIPTION OF THE PREFERRED EMBODIMENT

Figure 1:
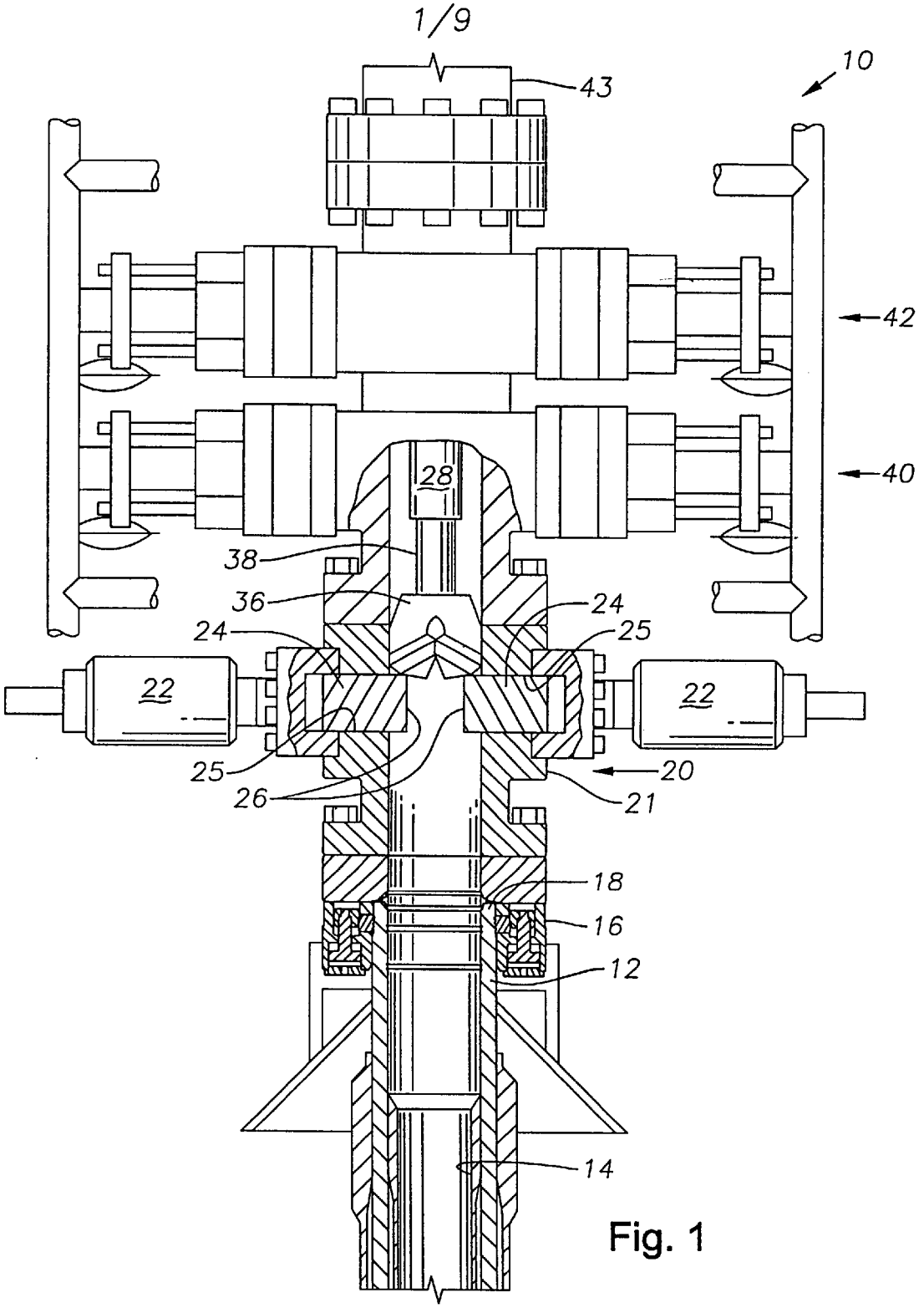
FIG. 1 is a partially-sectioned side view of a well, wherein a drill bit is landed on a first embodiment of a bit guide constructed in accordance with the invention.

Referring to FIG. 1, a well designated generally 10 has a wellhead housing 12. A casing hanger 14 is provided for receiving a tubing hanger and is located within wellhead housing 12. A wellhead connector 16 is affixed to an upper end 18 of wellhead housing 12. In a first embodiment of the present invention, a drill bit guide unit 20 having a spool 21 is affixed to wellhead connector 16. Although the invention is referred to as a "drill bit guide," it is also capable of guiding strings and tools through the wellhead without damage to the wellhead or string while drilling. Bit guide unit 20 is capable of withstanding high pressure. Preferably, bit guide unit 20 has a 15,000 psi internal pressure capacity. An actuator or first pair of linear actuators 22 are provided within bit guide unit 20. Linear actuators 22 radially extend and retract segmented elements or separate halves of a bit guide 24. Each bit guide 24 is located in a window 25 on opposite sides of spool 21. Each half of bit guide 24 has a concave bit guide surface 26 (best seen in FIG. 4). Bit guide surfaces 26 may be hard-faced. Bit guide surfaces 26 should approximate the curvature of a drill string 28 as shown in FIG. 4.

Figure 2:
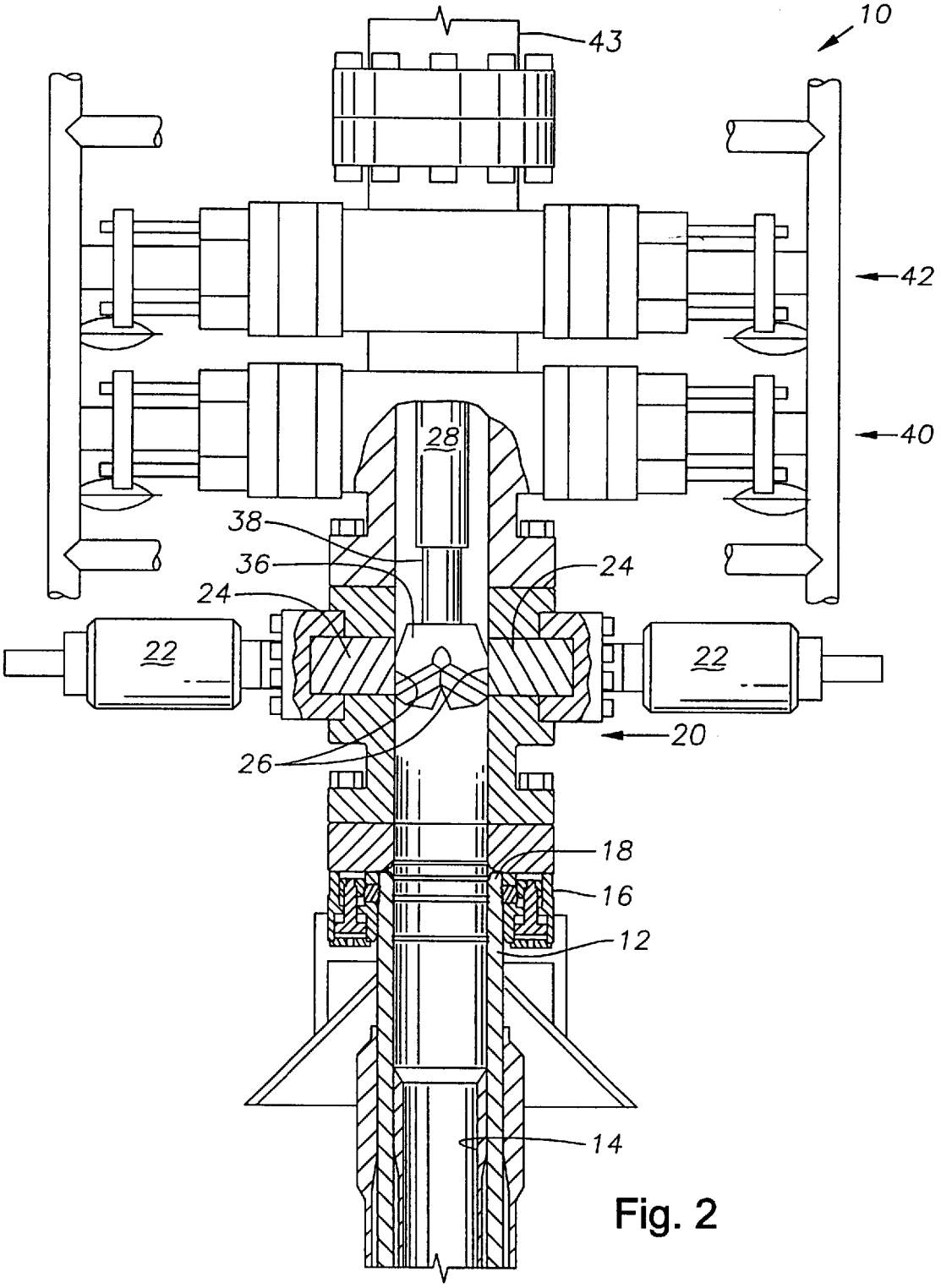
FIG. 2 is a partially-sectioned side view of the well of FIG. 1, wherein the drill bit is shown passing through the bit guide.

Linear actuators 22 are positionable in selected positions, including a closed position (FIG. 1) to provide a surface for landing a drill bit 36. In the closed position, the distance or diameter between bit guide surfaces 26 is less than an inner diameter of spool 21 and the outer diameter of drill bit 36. Linear actuators 22 may also be positioned in a second or bit passing position (FIG. 2). In the bit passing position, the distance between bit guide surfaces 26 is substantially equal to the inner diameter of spool 21. For example, the bit passing position shown in FIG. 2 may provide 17.5 inches of clearance between the concave bit surfaces 26. A third position for linear actuators 22 allows for passing and stabilizing drill string 28. An additional position may be provided to stabilize bottom hole (BH) assembly 38. BH assembly 38 may be several hundred feet in length. BH assembly 38 has drill collars and other tubular members typically larger in diameter than drill string 28. To stabilize BH assembly 38, when BH assembly 38 passes linear actuators 22, the actuators 22 extend the bit guide 24 to a position that closely engages the bit guide surfaces 26 with the BH assembly 38 to guide the BH assembly 38. Finally, the pistons or linear actuators 22 may be provided with a dampner system to allow upsets, such as tool joints on the drill pipe, to go through the centralizing actuators 22 without the need for repositioning actuators 22 from the surface control panel. In essence, this feature would allow actuators 22 to be self-adjusting and centralizing in the working mode.

Figure 5:
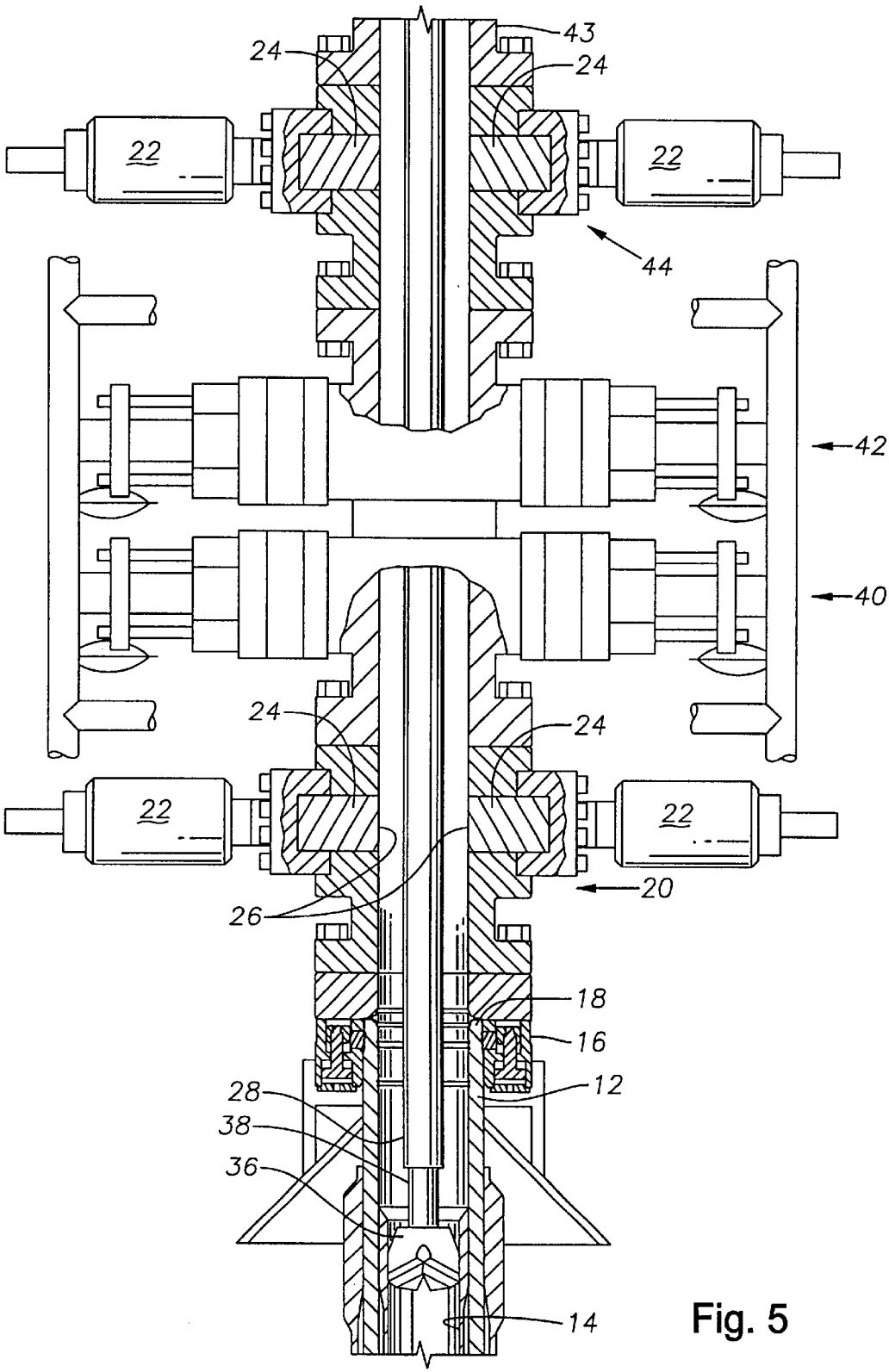
FIG. 5 is a partially-sectioned side view of a well having first and second bit guides constructed in accordance with the present invention.
Figure 6:
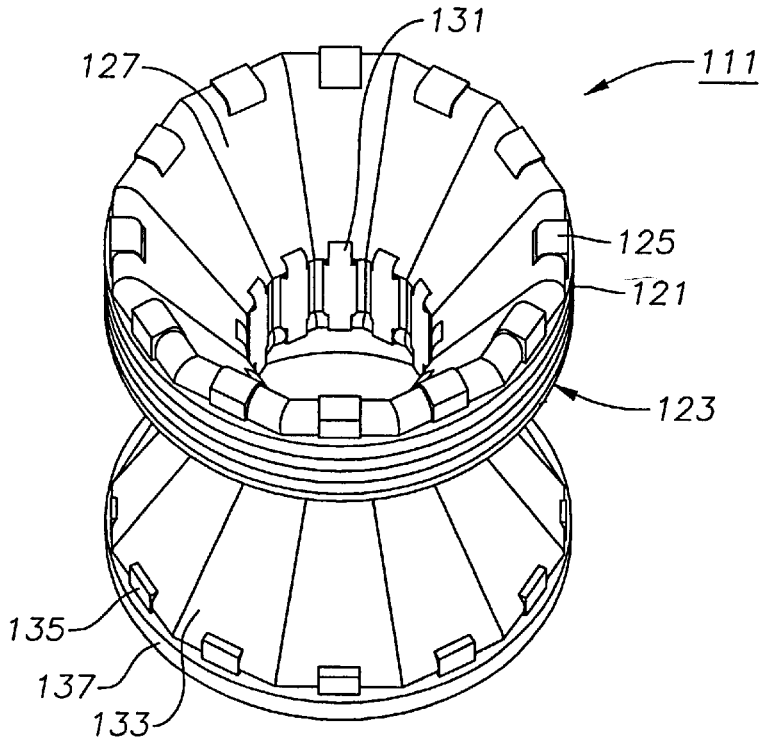
FIG. 6 is an isometric view of a second embodiment of a bit guide constructed in accordance with the invention and shown in a closed position.
Figure 7:
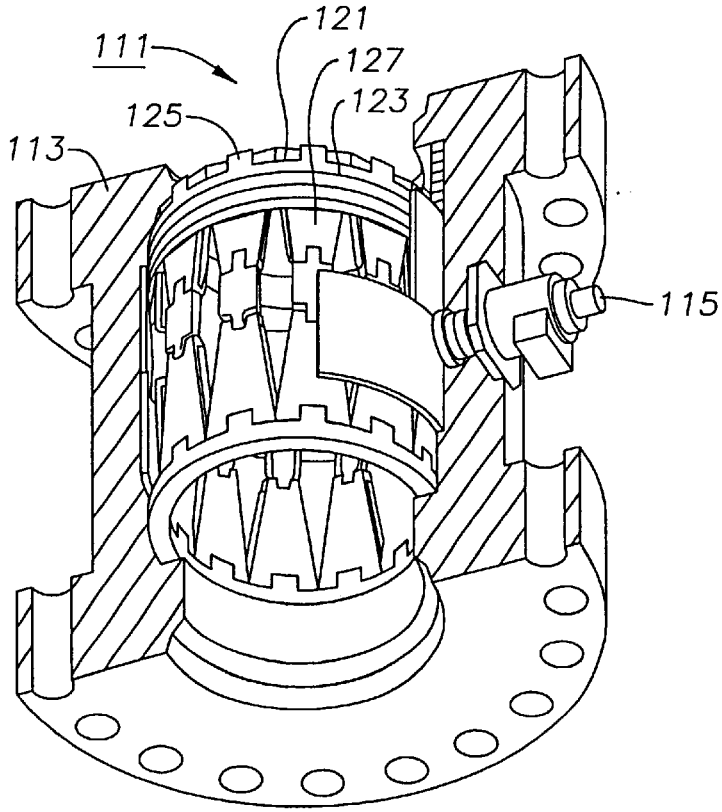
FIG. 7 is a partially-sectioned, isometric view of the bit guide of FIG. 6 installed in a well and shown in an open position.
Figure 8:
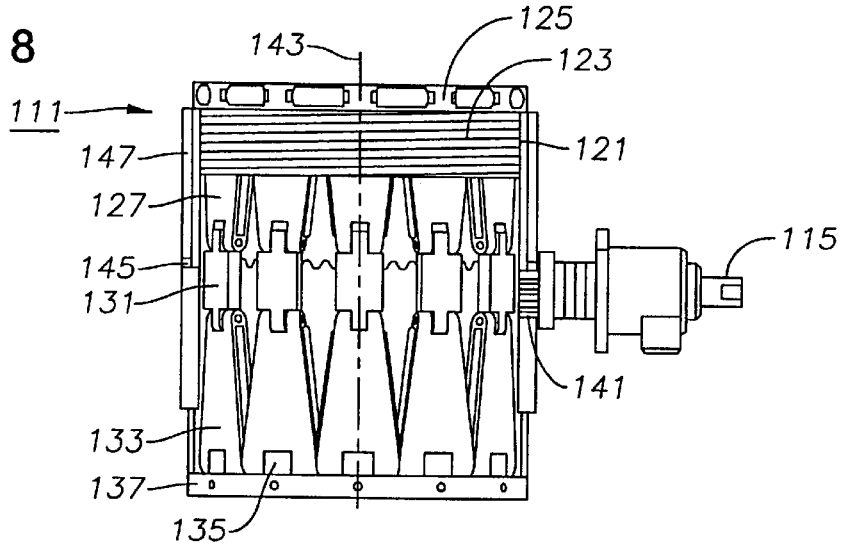
FIG. 8 is a partially-sectioned side view of the bit guide and well of FIG. 7 shown in the open position.

A blowout preventer 40 is provided above bit guide unit 20. Additionally, a second or upper blowout preventer 42 may also be located above the bit guide unit. Riser 43 extends to the surface. A second bit guide unit 44 (FIG. 5) may be located above the blowout preventer 42. The second bit guide unit 44 preferably has a 2,000 psi internal pressure capacity, which is considerably less than bit guide unit 20. Second bit guide unit 44 is provided to further stabilize the drill string 28. Second bit guide unit is similar to first bit guide unit 20, since each have a pair of actuators 22 and a bit guide 24.

In use, the bit guide unit 20 and/or 44 is used to prevent the BH assembly 38 or the drill bit 36 from making damaging contact with internal sidewall of wellhead housing 12. Linear actuators 22 are closed so that first bit guides 24 are proximate one another in bit guide unit 20. Drill string 28, with drill bit 36 on a lower end thereof, is lowered in a riser 43. Drill bit 36 lands first bit guide 24. By landing the first bit guides 24, the drill bit 36 is located by an operator.

Linear actuators 22 are opened to allow drill bit 36 to pass therethrough. Once drill bit 36 has passed through bit guide unit 20, first linear actuators 22 and bit guide 24 close around BH assembly 38 on drill string 28 to guide drill string 28 into the well. The diameter of the opening provided by bit guide 24 in this position is greater than in the closed position. Bit guide unit 20 prevents drill bit 36 from impacting the wellhead housing 12. However, an ample bypass area is provided between the drill string 28 when the actuators 22 are in the closed position so that well fluids may pass between the linear actuators 22 and the drill string.

Referring now to FIGS. 6–15, a second embodiment of the present invention is shown as bit guide 111. Like bit guide 11, bit guide 111 is a centering and wear reduction apparatus that is movable between a fully closed or drilling position (FIGS. 6, 9, 12, 13, and 15) having a very narrow central opening, and a fully open position (FIGS. 7, 8, 10, 11, and 14) having a wide central opening that is substantially equal to the inner diameter of a spool or wellhead connector 113 that it is mounted within. The opening in bit guide 111 also may be set to practically any diameter between the closed and open positions. In the preferred embodiment of FIGS. 7–13, bit guide 111 is actuated between these positions by a hydraulic motor 115 that is mounted to connector 113. Alternatively, a bit guide 111*b* may be actuated by a set of self-adjusting wave springs 117, 119 (FIGS. 14 and 15), located above and below bit guide 111, respectively, in connector 113*b*. These versions will be described in further detail below.

Bit guide 111 comprises a cylindrical upper actuator ring 121 that is formed from three arcuate sections. As shown in FIGS. 6–9, actuator ring 121 has a helical outer thread 123 that is dove-tailed, and a plurality (preferably 12) of mounting brackets 125 at its upper end. The upper end of an upper load arm 127 is mounted to each mounting bracket 125. Upper load arms 127 are substantially flat, but taper down in width from their upper ends to their lower ends. When bit guide 111 is in the open position, the lower ends of upper load arms 127 are spaced apart. However, when bit guide 111 is in the fully closed position, the lower ends of upper load arms 127 are located adjacent to one another to define a circular shape. Since the upper ends of upper load arms are mounted to actuator ring 121, they are always located adjacent to one another.

The upper end of a wear bar 131 is mounted to the lower end of each one of the upper load arms 127. Wear bars 131 are substantially flat sacrificial elements with a mounting hub on each end. The upper end of a lower load arm 133 is secured to the lower end of each of the wear bars 131. Lower load arms 133 are essentially mirror-images of upper load arms 127, as they taper down in width from their lower ends to their upper ends. The lower end of each lower load arm 133 is mounted to a mounting bracket 135 on a bottom retainer ring 137. Like upper actuator ring 121, bottom retainer ring 137 is formed from three arcuate sections. Note that in the fully open position, arms 127, 133 and wear bars 131 are locked together or interconnected such that a single vertical column or "linkage" of these elements is not permitted to move independently from the others.

As stated previously, bit guide 111 is actuated by motor 115 which has a drive gear 141 that is perpendicular to the axis 143 of wellhead 113. Drive gear 141 engages a set of teeth 145 located around the bottom edge of a cylindrical drive ring 147, which is also formed from three arcuate sections. Drive ring 147 is slightly larger in diameter than upper actuator ring 121 and surrounds the upper half of bit guide 111. Drive ring 147 also has a set of helical inner threads 149 (FIG. 9) that dovetail with the outer threads 123 of upper actuator ring 121.

Figure 9:
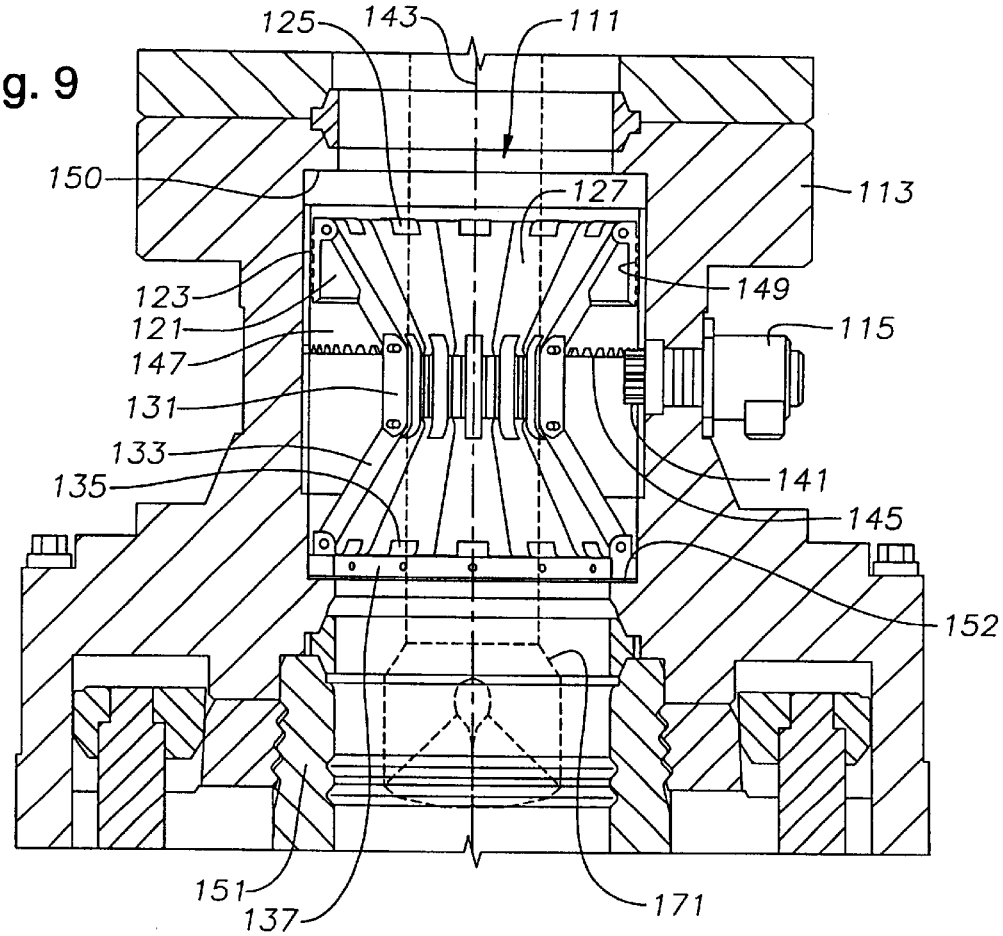
FIG. 9 is a partially-sectioned side view of the bit guide and well of FIG. 7 shown in the closed position.
Figure 11:
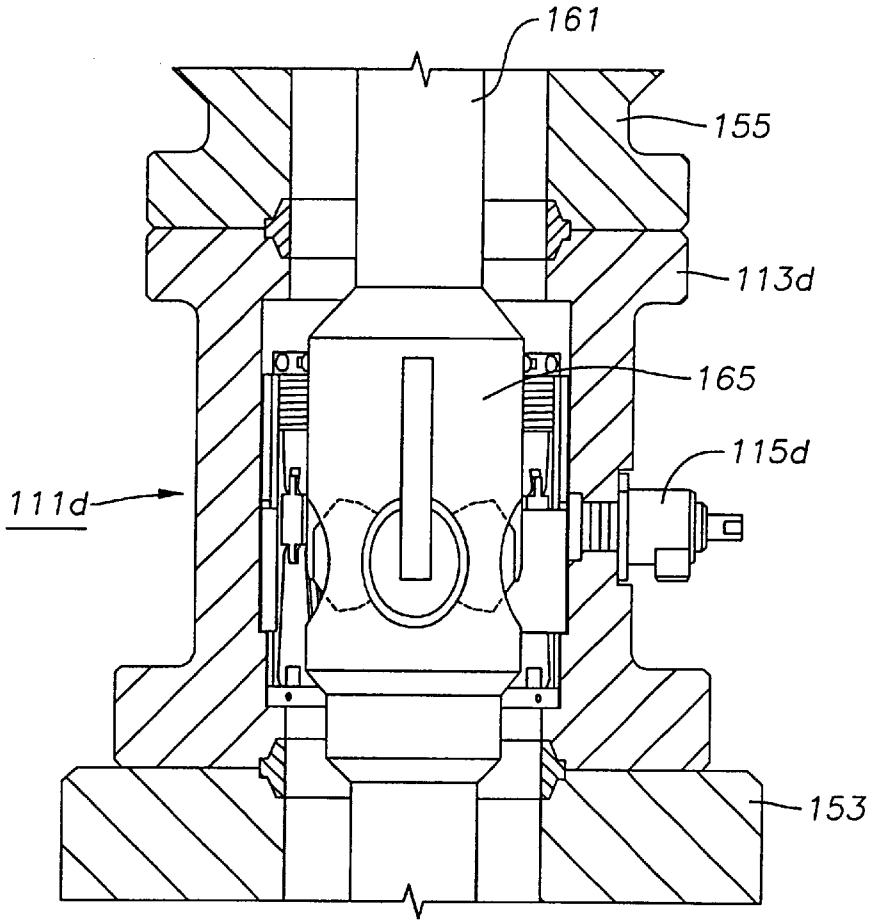
FIG. 11 is an enlarged sectional side view of the bit guide and well of FIG. 10.

In operation, motor 115 rotates drive gear 141 to rotate drive ring 147 via teeth 145. As drive ring 147 rotates about axis 143 in either direction, the threads 149 on the inner surface of drive ring 147 move actuator ring 121 in the axial direction via the threads 123 on the outer surface of actuator ring 121. As shown in FIG. 9, a clearance is provided between the top of actuator ring and an upper shoulder 150 in connector 113. The clearance allows bit guide 111 to increase its axial dimension as it increases the size of the opening in the radial direction between wear bars 131. Conversely, the axial dimension of bit guide 111 decreases as the size of the opening in the radial direction between wear bars 131 decreases. Bottom retainer ring 137 is landed on and locked in a lower shoulder 152 in connector 113, thereby preventing actuator ring 121 from rotating via the other elements in each linkage.

A linkage or vertical column is defined as three adjoined elements: one upper load arm 127, one wear bar 131, and one lower load arm 133. Thus, in the version shown, bit guide 111 uses twelve linkages that are interconnected by upper actuator ring 121 and bottom retainer ring 137. Upper actuator ring 121 and bottom retainer ring 137 are always parallel to each other. When bit guide 111 is in the open position, the three elements of each linkage vertically align to give bit guide 111 an overall cylindrical appearance. When bit guide 111 is in the fully closed position or any other position in between, the upper and lower load arms 127, 133 pivot to form a pair of inverted, frustoconical shapes or frameworks, respectively, that are separated by a cylindrical formation of the wear bars 131 in between. The frustoconical shapes are important features for guiding and landing the tools. Thus, when bit guide 111 is articulated to any configuration other than the fully open position, load arms 127, 133 are inclined at an acute angle relative to axis 143. However, wear bars 131 are always parallel to axis 143 and perpendicular to rings 121, 137.

Bit guide 111 may be used singularly (FIG. 9) or in combination with another bit guide 111 (FIGS. 10–13). In FIG. 9, connector 113 of bit guide 111 is adapted to be mounted directly to a wellhead 151 in a conventional manner, with other equipment mounted to the upper end of connector 113. When two bit guides 111 are used, the lower bit guide 111*c* (FIGS. 12–13) is mounted as previously stated, and the connector 113*d* of upper bit guide 111*d* (FIGS. 10–11) is adapted to be mounted on a connector 153. In the version shown, a ball joint 155 is mounted on top of connector 113*d*. In either case, bit guides 111 may be actuated to form openings of various diameters between the fully open and closed positions.

Figure 10:
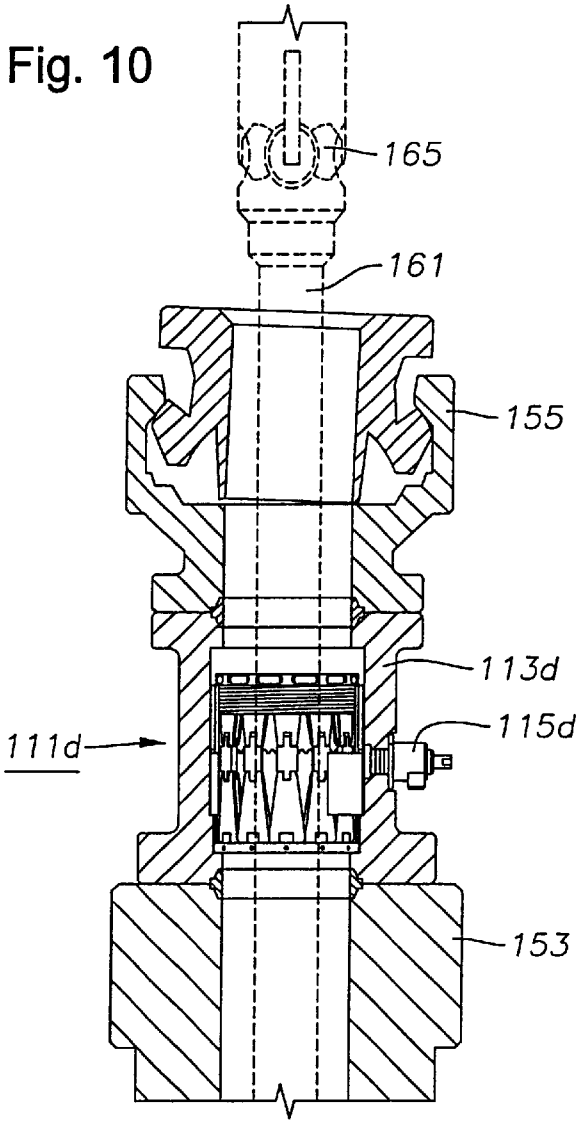
FIG. 10 is a sectional side view of the bit guide and well of FIG. 7 in operation with the bit guide in the open position.
Figure 13:
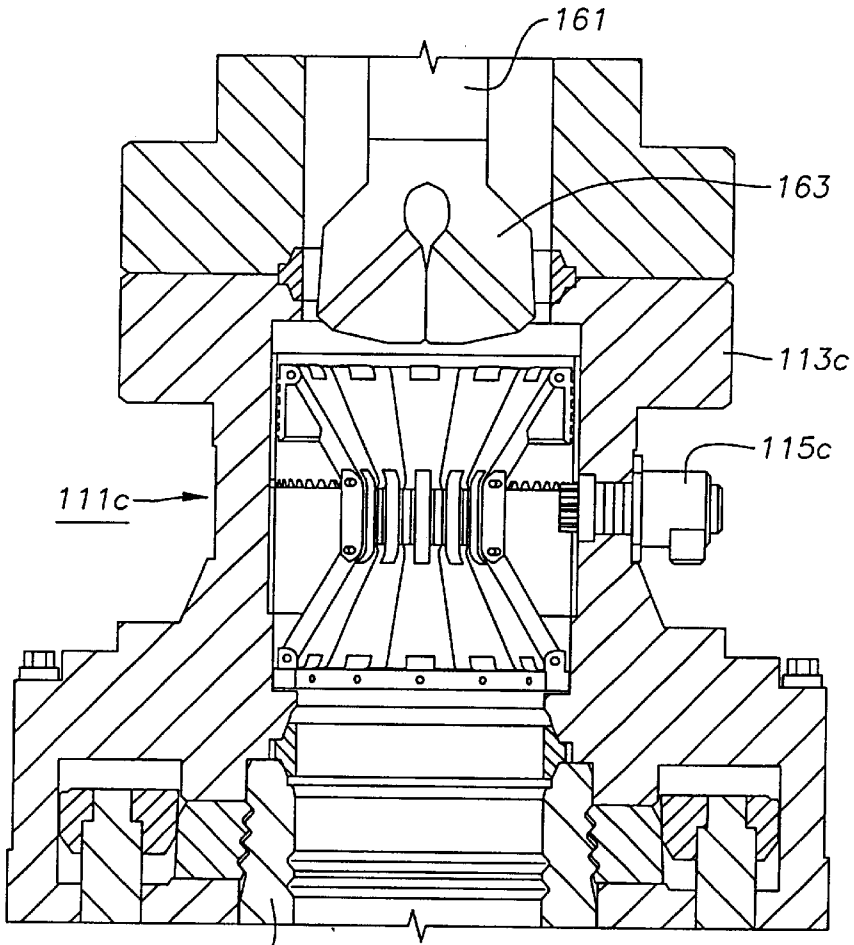
FIG. 13 is an enlarged sectional side view of the bit guide and well of FIG. 12.
Figure 12:
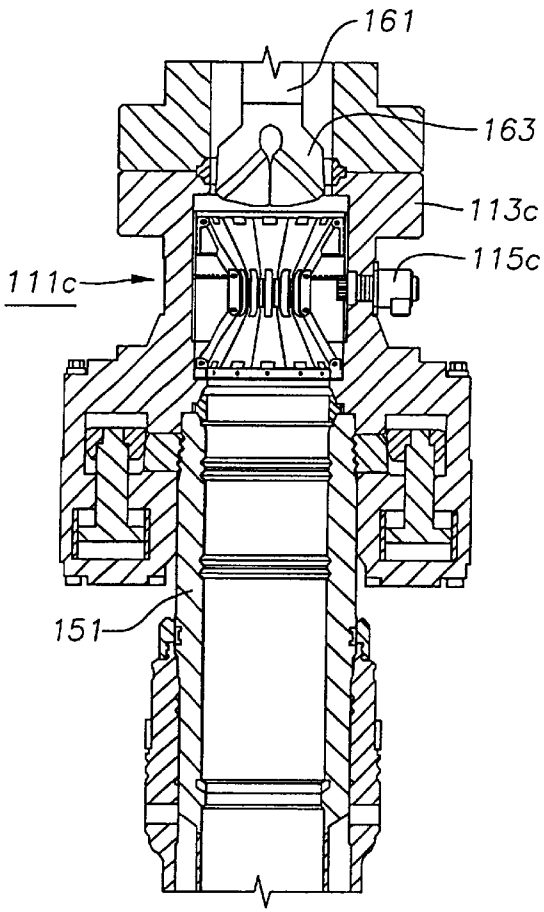
FIG. 12 is a sectional side view of the bit guide and well of FIG. 7 in operation with the bit guide in the closed position.

For example, in FIGS. 10, 12, and 13, a drill string 161 is lowered through fully open bit guide 111*d* such that its bit 163 is landed on top of the fully closed bit guide 111*c*. In this position, bit guide 111*c* provides a rigid stop funnel for bit 163. When bit guide 111*c* is opened to permit bit 163 to pass through, the closed underreamer 165 in drill string 161 can pass through bit guide 111*d*. More importantly, any of the bit guides 111 can be moved to more closely receive the object passing through it, such as drill string 171 (shown in phantom) in FIG. 9, to better protect the wellhead, drill string, and tools from incidental contact. When a bit guide 111 closely receives an object, the narrow diameter of the opening in bit guide 111 (defined between wear bars 131) is rigidly maintained such that the axis of the object substantially coincides with bit guide axis 143. Although a small gap may remain between the object and wear bars 131, the object is prevented from excess off-axis movement even if it is rotating about its own axis.

An optional wave spring (not shown) may be provided between the top of actuator ring 121 and the upper end of the profile in connector 113 to allow actuator ring 121 to move up, allowing bit guide 111 to open, in the event that a drill bit or other object is stuck below the bit guide when it is closed and the motor 115 does not function.

Figure 15:
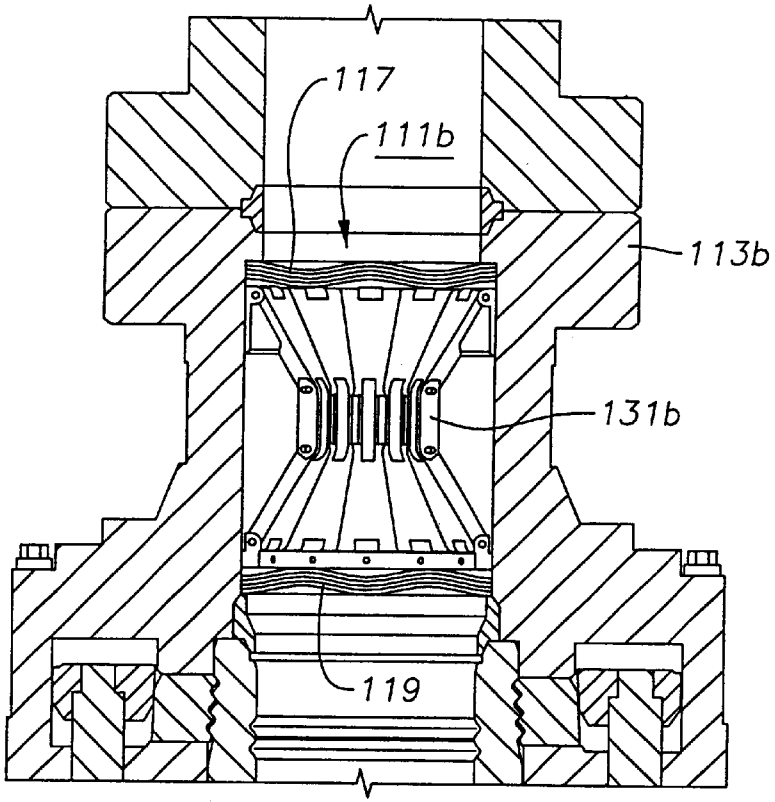
FIG. 15 is a sectional side view of the alternate embodiment of the bit guide of FIG. 14 shown in the well in the closed position.
Figure 14:
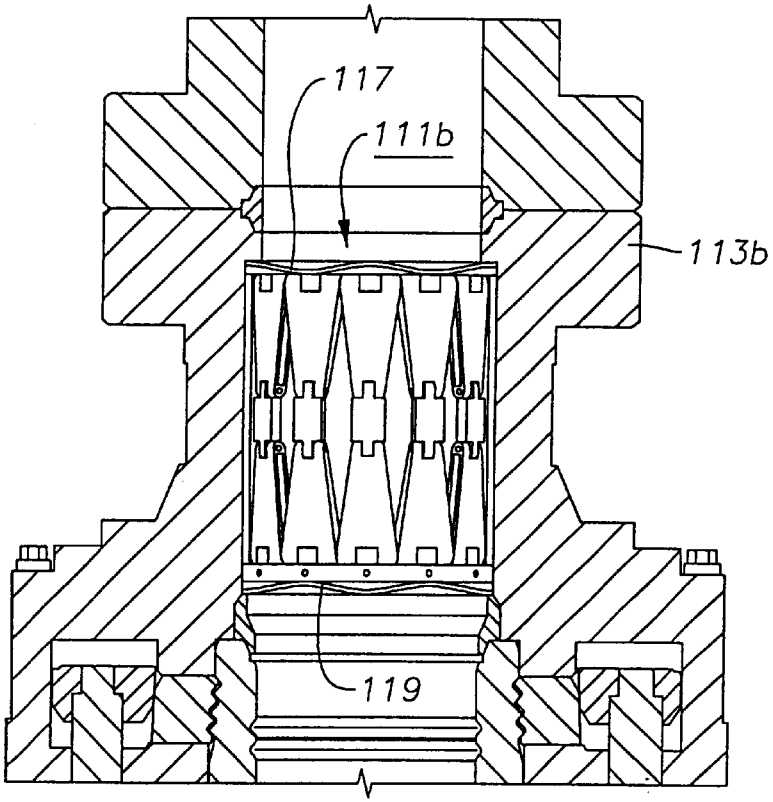
FIG. 14 is a sectional side view of an alternate embodiment of the bit guide of FIG. 6 shown in a well in the open position.

In the version of FIGS. 14 and 15, wave springs 117, 119 are biased to actuate bit guide 111*b* to the fully closed position. When an object lands on bit guide 111*b*, wave springs 117, 119 automatically self-adjust to permit wear bars 131*b* to form a snug-fitting opening on the exterior of the object. Thus, if an object is lowered or raised through bit guide 111*b*, the inner diameter of its opening automatically conforms to the outer diameter of the object.

The present invention has numerous advantages. Running bit guides in deep water is time consuming and expensive. The bit guide units of the present invention eliminate the need for wear bushings by centralizing the drill pipe to prevent damage to the drill bit and to the wellhead housing. The bit guides have a retracted or open position in which the bore is fully open to BOP equipment, and a closed position in which the diameter of the bore is reducible to approximately the diameter of the tooling therein. In the second embodiment, the upper and lower arms and the wear bars are expendable and easily replaced in the field through the inner diameter. In addition, the bit guides may be remotely operated from the rig floor or by an ROV. The bit guides also may be provided with optional automatic adjustment and/or an absolute position indicator. The components of the bit guide are preferably coated such that they are self-cleaning.

While the invention has been shown or described in only some of its forms, it should be apparent to those skilled in the art that it is not so limited, but is susceptible to various changes without departing from the scope of the invention. For example, a solid elastomeric toroid or donut having inner wear plates may be used for some applications.

What is claimed is:

1. In a subsea well assembly including a riser, a blowout preventer at a lower end of the riser, and a subsea wellhead below the blowout preventer, an apparatus for protecting the wellhead from a drill string and drill bit lowered therethrough, comprising:

a spool having an axis and an inner diameter, the spool being coaxially mounted to an upper end of the wellhead, the blowout preventer being connected to an upper end of the spool; and a bit guide mounted to the spool and radially movable relative thereto between an open position, wherein the bit guide defines a first opening having a first diameter that is substantially equal to the inner diameter of the spool, and a closed position, wherein the bit guide defines a second opening having a second diameter that is smaller than the inner diameter of the spool.

2. The assembly of claim 1, wherein the bit guide is variably adjustable between the open and closed positions.

3. The assembly of claim 1, wherein the second diameter is adapted to be smaller than an outer diameter of the drill bit, such that the bit guide is adapted to provide a landing for the drill bit when in the closed position.

4. The assembly of claim 1, further comprising a pair of linear actuators located on opposite sides of the spool for moving the bit guide between the open and closed positions.

5. The assembly of claim 1, wherein the bit guide has segmented elements with concave inner surfaces that define the first a second openings.

6. The assembly of claim 1, wherein the bit guide comprises a plurality of interconnected linkages.

7. The assembly of claim 1, wherein the bit guide comprises a first member that rotates relative to a second member to move the second member in an axial direction, such that the second member pivots a set of third members to the open and closed positions.

8. The assembly of claim 1, further comprising:

an upper spool having an axis and an inner diameter, the upper spool being coaxially mounted to an upper end of the blowout preventer above said first mentioned spool; and an upper bit guide mounted to the upper spool and radially movable relative thereto between an open position, wherein the upper bit guide defines a first opening having a first diameter that is substantially equal to the inner diameter of the upper spool, and a closed position, wherein the upper bit guide defines a second opening having a second diameter that is smaller than the inner diameter of the upper spool.

9. In a subsea well assembly including a riser, a blowout preventer at a lower end of the riser, and a subsea wellhead at a lower end of the blowout preventer, an apparatus for supporting a drill string extending through the wellhead, comprising:

a spool having an axis, an inner diameter, and a pair of windows located on opposite sides of the spool, wherein the spool is adapted to be coaxially mounted on the wellhead;

a bit guide located in each of the windows of the spool;

a linear actuator mounted adjacent to each of the bit guides in the spool, wherein the linear actuators move the bit guides radially relative to the spool between an open position, wherein the bit guides define a maximum diameter that is substantially equal to the inner diameter of the spool, a closed position, wherein the bit guides define a minimum diameter that is smaller than the inner diameter of the spool; and wherein the bit guides are variably adjustable between the open and closed positions to define a plurality of diameters therebetween or supporting the drill string located within the wellhead.

10. The assembly of claim 9, wherein the minimum diameter is adapted to be smaller than an outer diameter of the drill string located within the wellhead, such that the bit guides are adapted to provide a landing for the drill string when in the closed position.

11. The assembly of claim 9, wherein the bit guides have concave inner surfaces.

12. The assembly of claim 9, further comprising:

an upper spool having an axis and an inner diameter, the upper spool being coaxially mounted to an upper end of the blowout preventer above said first mentioned spool; and an upper bit guide mounted to the upper spool and radially movable relative thereto between an open position, wherein the upper bit guide defines a first opening having a first diameter that is substantially equal to the inner diameter of the upper spool, and a closed position, wherein the upper bit guide defines a second opening having a second diameter that is smaller than the inner diameter of the upper spool.

13. In a subsea well drilling assembly having a riser, a blowout preventer at a lower end of the riser, and a subsea wellhead at a lower end of the blowout preventer, the improvement comprising:

an upper bit guide located a the lower end of the riser and above the blowout preventer for centering a drill string within the blowout preventer; and a lower bit guide above the wellhead and below the blowout preventer for centering the drill string within the wellhead.

14. The subsea well drilling assembly according to claim 13, wherein each of the bit guides is movable between an expanded diameter position and a restricted diameter position.

15. A method for drilling a subsea well through a subsea assembly including a riser, a blowout preventer at a lower end of the riser, and a subsea wellhead at a lower end of the blowout preventer, the method comprising:

(a) mounting an upper bit guide at the lower end of the riser and above the blowout preventer;

(b) mounting a lower bit guide above the wellhead and below the blowout preventer; and (c) lowering a drill string with a drill bit through the riser, blowout preventer and a bore of the wellhead, and centering the drill bit in the bore with the upper and lower bit guides.

16. The method according to claim 15, wherein steps (a) and (b) comprise:

providing the bit guides with actuators that move the bit guides between a larger diameter opening and a smaller diameter opening; and step (c) further comprises:

with the actuators, moving the bit guides to a larger diameter position while the bit passes through each of the bit guides and moving the bit guides to a smaller diameter position after the bit passes through each of the bit ides.

17. The method according to claim 15, wherein the bit guides are movable between an expanded position having a diameter at leas equal to that of the bit and a restricted position having a diameter smaller than the bit; and step (c) further comprises:

moving the bit guides to the expanded position while the bit passes through each of the bit guides and moving the bit guides to the retracted position after the bit passes through each of the bit guides.

* * * * *